US009763513B2

(12) United States Patent
Cai et al.

(10) Patent No.: US 9,763,513 B2
(45) **Date of Patent: *Sep. 19, 2017**

(54) LOCKING MECHANISM FOR A FOLDING TABLE

(71) Applicant: LIFETIME PRODUCTS, INC., Clearfield, UT (US)

(72) Inventors: Jinlong Cai, Xiamen (CN); Kwang Ho Baik, Xiamen (CN)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,460

(22) Filed: Mar. 8, 2016

(65) Prior Publication Data

US 2016/0183673 A1 Jun. 30, 2016

Related U.S. Application Data

(63) Continuation of application No. 14/167,905, filed on Jan. 29, 2014, now Pat. No. 9,277,808.
(Continued)

(51) Int. Cl.

| | |
|---|---|
| ***A47B 3/083*** | (2006.01) |
| ***A47B 3/08*** | (2006.01) |
| ***A47B 13/00*** | (2006.01) |
| ***A47B 3/091*** | (2006.01) |
| ***A47B 3/087*** | (2006.01) |

(52) U.S. Cl.
CPC ..... *A47B 3/0818* (2013.01); *A47B 3/087* (2013.01); *A47B 3/0912* (2013.01); *A47B 13/00* (2013.01); *A47B 2003/0821* (2013.01); *Y10T 74/20648* (2015.01)

(58) Field of Classification Search
CPC ..... A47B 3/087
USPC ..... 108/115, 129, 130, 131, 132, 162, 167, 108/168, 169, 171, 172, 173, 174
See application file for complete search history.

(56) References Cited

U.S. PATENT DOCUMENTS

| | | | |
|---|---|---|---|
| 2,643,926 | A | 6/1953 | Pucci et al. |
| 2,760,559 | A | 8/1956 | Austin et al. |

(Continued)

FOREIGN PATENT DOCUMENTS

| | | |
|---|---|---|
| CN | 1627908 | 6/2005 |
| CN | 202739180 | 2/2013 |
| CN | 202820137 | 3/2013 |

OTHER PUBLICATIONS

U.S. Appl. No. 61/758,227, filed Jan. 29, 2013, Cai.
(Continued)

*Primary Examiner* — Matthew Ing
(74) *Attorney, Agent, or Firm* — Maschoff Brennan

(57) ABSTRACT

A foldable table may include a table top and legs that are movable between an extended position and a collapsed position. The table top may include a first section and a second section that are connected by a hinge assembly. A locking member may be sized and configured to lock the hinge assembly in a fixed position. Advantageously, moving the legs between the extended and collapsed positions may cause the locking mechanism to move between the locked and unlocked positions. Thus, when the legs are in the extended position and the locking mechanism is in the locked position, the table top may be secured in the unfolded position.

20 Claims, 12 Drawing Sheets

Related U.S. Application Data

(60) Provisional application No. 61/758,227, filed on Jan. 29, 2013.

(56) References Cited

U.S. PATENT DOCUMENTS

| | | | | |
|---|---|---|---|---|
| 2,994,093 | A | 8/1961 | Wagner | |
| 3,093,095 | A | 6/1963 | Howe et al. | |
| 3,141,424 | A | 7/1964 | Seymour | |
| 4,218,092 | A | 8/1980 | Schach et al. | |
| 4,927,128 | A | 5/1990 | O'Brian | |
| 6,223,661 | B1 | 5/2001 | Griepentrog | |
| 6,334,400 | B1 | 1/2002 | Nien | |
| 6,565,156 | B1 | 5/2003 | Yamashita et al. | |
| 7,278,361 | B2 * | 10/2007 | Zhurong | A47B 3/0912 108/132 |
| 7,278,515 | B2 | 10/2007 | Moser et al. | |
| 7,299,754 | B2 | 11/2007 | Stanford et al. | |
| 7,621,224 | B2 | 11/2009 | Lin et al. | |
| 7,707,948 | B2 | 5/2010 | Lin | |
| 8,555,791 | B2 | 10/2013 | Jin et al. | |
| 8,904,943 | B2 | 12/2014 | Jin et al. | |
| 2004/0187749 | A1 | 9/2004 | Zhurong et al. | |
| 2005/0274302 | A1 | 12/2005 | Jin et al. | |
| 2008/0022906 | A1 | 1/2008 | Stanford | |
| 2008/0202390 | A1 | 8/2008 | Branch et al. | |
| 2008/0284216 | A1 | 11/2008 | Mayercheck | |
| 2011/0203493 | A1 * | 8/2011 | Ashby | A47B 3/0818 108/127 |
| 2013/0025509 | A1 * | 1/2013 | Jin | A47B 3/087 108/166 |
| 2013/0233210 | A1 * | 9/2013 | Jin | A47B 3/0818 108/166 |

OTHER PUBLICATIONS

U.S. Appl. No. 13/604,478, filed Sep. 5, 2012, Jin, et al.
International Search Report and Written Opinion dated Oct. 15, 2012 from PCT International Application No. PCT/US2012/048480.
Office action from U.S. Appl. No. 13/559,003 dated Oct. 26, 2012. Notice of Allowance from U.S. Appl. No. 13/559,003 dated Jun. 11, 2013. Office Action from U.S. Appl. No. 13/604,478 dated Dec. 13, 2013. International Preliminary Report on Patentability from PCT/US2020/048485 dated Feb. 4, 2014.

* cited by examiner

LOCKING MECHANISM FOR A FOLDING TABLE

CROSS-REFERENCE TO RELATED APPLICATIONS

This application is a continuation of U.S. patent application Ser. No. 14/167,905, filed Jan. 29, 2014, now U.S. Pat. No. 9,277,808, issued Mar. 8, 2016.

U.S. patent application Ser. No. 14/167,905, filed Jan. 29, 2014, now U.S. Pat. No. 9,277,808, issued Mar. 8, 2016, claims priority to and the benefit of U.S. Provisional Patent Application Ser. No. 61/758,227, entitled LOCKING MECHANISM FOR A FOLDING TABLE, which was filed on Jan. 29, 2013, and is hereby incorporated by reference in its entirety.

BACKGROUND OF THE INVENTION

Field of the Invention

The present invention generally relates to furniture and, in particular, to tables that are capable of being folded and unfolded.

Description of Related Art

Many types of tables are well known and used for a variety of different purposes. For example, conventional tables may include legs that are pivotally attached to a table top and the legs may be movable between a use position in which the legs extend outwardly from the table top and a storage position in which the legs are folded against an underneath portion of the table top. Conventional tables with relatively large table tops and folding legs are often referred to as "banquet tables" and these types of tables are frequently used in assembly halls, banquet halls, convention centers, hotels, schools, churches and other locations where large groups of people meet. When the tables are no longer needed, the table legs can be moved into the storage position and the tables may be moved or stored.

The table top for many conventional banquet tables may retain its relatively large size and shape. For example, many known banquet tables have a length between six and ten feet and a width between three and four feet. As a result, many conventional banquet tables require a large storage area even when the legs are in the collapsed position. This large storage area may be especially problematic for larger facilities such as hotels, schools and churches because a considerable number of these tables may have to be stored. Thus, a significant amount of storage space may be required. In addition, smaller facilities such as restaurants, offices and homes may use one or more conventional banquet tables. These smaller facilities may use the tables less frequently, such as during special occasions and events. Conventional banquet tables, even when the legs are folded, are often too bulky and awkward to be conveniently stored at such smaller facilities. As a result, it is often necessary for both larger and smaller facilities to rent and/or borrow banquet tables when needed. Disadvantageously, renting and/or borrowing banquet tables can be inconvenient, time consuming and costly.

Conventional banquet tables are often difficult to move or transport from one location to another. For example, because of the length of many conventional banquet tables, it may be problematic for a single person to move the table. In addition, the extended length may preclude many banquet tables from being transported in the trunk or back seat of a typical passenger car. Accordingly, conventional banquet tables may have to be transported by a truck, trailer or oversized vehicle such as a sports utility vehicle. These and other factors may make conventional banquet tables time consuming and expensive to move.

It is also known to construct tables that are capable of being folded in half. In particular, many conventional fold-in-half tables include a table top with two sections pivotally connected by hinges. The sections usually have the same size and shape, and the hinges are typically located at the center of the table top. The sections of the table top may be moved between an unfolded or use position in which the sections of the table top are generally aligned in the same plane and a folded or collapsed position in which the sections are positioned generally adjacent to each other for storage.

Disadvantageously, many conventional fold-in-half tables are unable to support a significant amount of weight. For example, the connection between the sections of the table top for many known fold-in-half tables is relatively weak, which may allow a portion of the table top to undesirably sag or slump. Additionally, the connection between the sections may be relatively frail and may break if a significant load or force is applied to the table top. In order to construct a stronger table, it is known to make the table top sections out of stronger and thicker materials. This may increase the weight of the table top, which may make the table more difficult to manufacture, ship, carry and move.

An additional shortcoming of many conventional fold-in-half tables is the tables may be relatively difficult and time consuming to use. For example, multiple steps may be required to set up and take down conventional fold-in-half tables. In particular, a conventional folding table may have to be unfolded, first and second leg assemblies moved from collapsed to extended positions, a first locking ring moved into a locked position to secure the first leg assembly in a locked position, a second locking ring moved into a locked position to secure the second leg assembly in a locked position, and then a sliding bolt may be used to lock the table top in the use or unfolded position. Thus, numerous steps may be required before the table can be used. In addition, many of the same steps may be required to fold or store the table. For instance, the sliding bolt may have to be manually unlocked and the locking rings moved from the locked to the unlocked positions. The first and second leg assemblies may then be moved from the extended to the collapsed positions and the table top may be folded into the collapsed position. Therefore, a number of steps may be required each time the table is desired to be used, moved and/or stored.

BRIEF SUMMARY OF EMBODIMENTS OF THE INVENTION

A need therefore exists for a table that eliminates or diminishes the disadvantages and problems described above.

One aspect is a table that may include a table top and one or more support structures or legs. The support structures may be movable between an extended or use position and a collapsed or storage position relative to the table top. When the support structures are in the use position, the support structures may extend outwardly and away from the table top. When the support structures are in the collapsed position, the support structures may be disposed generally parallel and at least proximate a lower or underneath portion of the table top. At least a portion of the support structures may contact or abut the lower portion of the table top when the support structures are in the collapsed position. Advantageously, when the support structures are in the use position, the table may support a wide variety of objects and the table may be used for different purposes. When the support structures are in the collapsed position, the table may be more easily moved, stored and/or transported.

Another aspect is a table that may include a table top which is capable of being folded and unfolded. For example, the table top may include two sections that are generally aligned in the same plane when the table top is in the unfolded position. The table top sections may be generally parallel and adjacent to each other when the table top is in the folded position. The table may also include support structures movable between use and collapsed positions. Advantageously, if the table includes both a foldable table top and movable support structures, the table may be disposed and/or stored in a relatively compact area. This may allow, for example, a single person to easily move and transport the table. In addition, this may allow the table to be positioned in a relatively small area, such as the backseat or trunk of an automobile. This may further allow one or more tables to be shipped and/or stored in relatively small areas, which may decrease transportation and storage costs.

Still another aspect is a table that may include a table top constructed from plastic and the plastic table top may be constructed using a blow-molding process. Advantageously, a blow-molded plastic table top may be lightweight, easily constructed and formed into a desired shape, size, configuration and design. The blow-molded plastic table top may also be generally weather resistant and temperature insensitive, which may allow the table to be used in a wide variety of locations and environments. In addition, the blow-molded plastic table top may be durable, long-lasting and corrosion resistant. Further, the blow-molded plastic table top may be relatively strong and used to support a large amount of weight. Significantly, the blow-molded plastic table top may form a structural member of the table and various features may be integrally formed in the table top as part of a unitary, one-piece construction.

Advantageously, a blow-molded plastic table top may be relatively strong because it may include opposing walls or surfaces separated by a distance. In particular, the opposing walls may be separated by a generally constant distance and the table top may have generally uniform characteristics and features, which may help create a table top with generally uniform properties such as strength, rigidity and structural integrity. In addition, because a hollow interior portion may be formed during the blow-molding process, that may facilitate construction of a lightweight table top. Thus, the blow-molded plastic table top may be both lightweight and strong. The table top could also be formed from other suitable processes, such as injection, rotational, extrusion, vacuum or thermoforming processes, and the table top could be constructed using other appropriate materials such as metal (including steel, aluminum, etc.), polymers, composites and the like.

Yet another aspect is a table that may include a frame attached to the table top. The frame may be sized and configured to allow the table top to be moved between the folded and unfolded positions. For example, the frame may include one or more elongated members, such as rails, that may extend along a length of the table top. The elongated members may be disposed towards or at least proximate the side of the table top, such as side rails. At least a portion of the side rails, for instance, may be disposed at least proximate a side of the table top. The elongated members may be connected to first and second sections of the table top, and the elongated members may be pivotally connected by one or more hinge assemblies. In particular, a first portion of a side rail may be connected to the first section of the table top and a second portion of the side rail may be connected to the second section of the table top, and a hinge assembly may connect to the first and second portions of the first side rail. This may allow a strong and sturdy table top to be constructed. Depending upon the size and configuration of the table top, any suitable number of elongated members or side rails may be used.

Still yet another aspect is a table that may include a locking mechanism which secures at least a portion of the table in a fixed position. For example, the table may include a locking mechanism that locks the table top in the unfolded or use position. In particular, a locking member may be moved between locked and unlocked positions, which may secure the table top in the use position or allow the table top to be folded. Advantageously, the locking mechanism may simply and quickly lock the table top in a fixed position.

A further aspect is a table, such as a folding or fold-in-half table, that may include a table top with first and second sections connected by one or more hinges, which may form at least a portion of a hinge assembly. In particular, a frame may be connected to first and second sections of the table top, and two hinge assemblies may be connected to the frame. The hinge assemblies may be connected by a cross member, which may extend across at least a portion of the table top and may be disposed along an axis of rotation that the table top rotates when the table top is moved between the folded and unfolded positions. The table may also include one or more support structures, such as one or more legs. A cross brace may interconnect the support structure and the cross member, and movement of the support structure may move the cross brace. For instance, the movement of the support structure between the extended and collapsed positions may move the cross brace between the extended and collapsed positions. The movement of the cross brace may move the cross member between first and second positions. For example, the movement of the support structure and/or cross brace may cause the cross member to move. In greater detail, the movement of the support structure and/or cross brace may cause the cross member to rotate about an axis. The movement of the cross member may move a locking mechanism between locked and unlocked positions. Specifically, the rotation of the cross member may lock and unlock the locking mechanism.

Advantageously, movement of the support structure may cause the cross brace to move, which may rotate the cross member, and that may lock or unlock the locking mechanism. In greater detail, one end of the cross brace may be connected to the support structure and the other end of the cross brace may be connected to the cross member. If desired, the end of the cross brace may be connected to the cross member in a fixed position, such as by welding or fasteners. The movement of the support member and the cross brace may rotate the cross member, which may lock and unlock the locking mechanism. For instance, a first connector may be connected to the cross member and it may engage a second connector that moves a locking member between the locked and unlocked positions when the cross member moves. When the locking member is in the locked position, it may prevent the table top from being folded or moved into the collapsed position. For example, the locking member may prevent one or both of the hinge assemblies from rotating, which may lock the table top in a fixed position.

Another further aspect is a table in which movement of a support structure may lock the table top in the use position. For example, the table top may be locked in the use position when the support structure is moved from the collapsed to the extended position. On the other hand, the table top may be unlocked when the support structure is moved from the extended to the collapsed position, which may allow the table top to be folded.

A still further aspect is a table that may be quickly and easily manufactured. In particular, the table may include relatively few components and the components may be quickly and easily produced. Additionally, a straightforward design may facilitate manufacturing of the table. The table may also be quickly and easily assembled and the table may have increased reliability because it may have few moving parts. The table may be shipped in assembled or unassembled configurations, and retailers or consumers may assemble the table if desired.

Another aspect is a folding table in which movement of a support structure from the collapsed to the extended position may cause the following to occur: the cross brace moves from the collapsed to the extended position, the cross member rotates from the first to the second position, one or more connectors rotate from a first to a second position, and the locking mechanism moves from the unlocked to the locked position to secure the table top in the unfolded position. The locking mechanism may include a locking member that is moved between unlocked and locked positions to secure the table top in a fixed position.

Still another aspect is a folding table in which the cross member may be rotatable relative to the hinge assembly. In particular, the cross member may be rotatable between first and second positions relative to the hinge assembly. The cross member may also be coupled to the locking mechanism and rotation of the cross member may lock and unlock the locking mechanism. The cross member and the locking mechanism may be connected by one or more connectors and at least a portion of the connectors may be disposed at least proximate or between one or more flanges of the hinge assemblies and/or locking mechanism. For instance, the locking mechanism may include two or more flanges and one or more of the connectors may be at least partially, substantially or entirely disposed between the flanges. Advantageously, this may help position and/or protect the connectors from damage.

Yet another aspect is a folding table that may include a support structure receiving portion in a body of a cross brace sized and configured to receive a portion of the support structure when the support structure and the cross brace are in the collapsed positions. The folding table may further include a first receiving portion, which may be integrally formed in the lower surface of the table top as part of a unitary, one-piece construction, which is sized and configured to receive an elongated body of the cross brace when the cross brace is in the collapsed position; and a second receiving portion, which may be integrally formed in the lower surface of the table top as part of the unitary, one-piece construction, which is sized and configured to receive the support structure receiving portion of the cross brace when the cross brace is in the collapsed position.

Still yet another aspect is a folding table that may include a support structure receiving portion in the cross brace sized and configured to receive a portion of the support structure when the support structure and the cross brace are in the collapsed positions, and the portion of the support structure disposed in the receiving portion may be generally aligned with an axis extending through a body of the cross brace. The folding table may further include a first plurality of engagement members connected to the cross member, and the first plurality of engagement members may be sized and configured to engage a second plurality of engagement members that may be connected to the locking mechanism. In greater detail, the first plurality of engagement members may be sized and configured to move the second plurality of engagement members when the cross member is moved, which may lock and/or unlock the locking mechanism. In particular, a first connector may be connected to the cross member, a second connector may engage the first connector, and a locking member may be connected to the second connector. The rotation of the first connector may rotate the second connector, which may lock and/or unlock the locking mechanism.

A further aspect is a method of securing a folding table in a locked or unlocked position by moving a support structure between collapsed and extended positions. For instance, the folding table may include a table top with first and second portions movable between folded and unfolded positions; one or more hinge assemblies may connect the first and second portions of the table top; a support structure may be movable between extended and collapsed positions relative to the table top; a cross brace may be movable between extended and collapsed positions; a cross member may be movable between one or more positions relative to the table top; and a locking mechanism may include a locked position in which the hinge assembly is secured in a fixed position and an unlocked position in which the hinge assembly is capable of moving or rotating. The cross brace may be coupled to the support structure and the cross member, and movement of the support structure may cause the cross brace and cross member to move. The method may include disposing the folding table with the table top in the folded position and the support structure in the collapsed position. The method may include unfolding the table top and moving the support structure from the collapsed position to the extended position, which may cause the cross brace to move from the collapsed position to the extended position, and the cross member to move from the first position to the second position, which may cause the locking mechanism to move from the unlocked position to the locked position. Advantageously, when the support structure is in the extended position and the locking mechanism is in the locked position, the table top may be secured in the unfolded position.

Another further aspect is a folding table that may include a table top with first and second portions that are movable between folded and unfolded positions; a frame with a first portion connected to the first portion of the table top and a second portion connected to the second portion of the table top; a hinge assembly connecting the first and second portions of the frame; a support structure movable between extended and collapsed positions relative to the first portion of the table top; a cross member which may be connected to the hinge assembly and rotatable between first and second positions; a cross brace movable between extended and collapsed positions and coupled to the support structure; and a locking mechanism rotatably coupled to the cross member. The movement of the support structure between the extended and collapsed positions may cause the locking mechanism to move between the locked and unlocked positions, and when the support structure is in the extended position and the locking mechanism is in the locked position, the table top may be secured in the unfolded position. The cross member and the locking mechanism may be connected by one or more connectors. For example, at least a portion of a first connector may be connected to the cross member, a second connector may be connected to the first connector, and a locking member may be connected to the second connector. The connectors may be rotatably connected and the rotational movement of the cross member between first and second positions may cause the first and second connectors to rotate, which may cause the locking member to move between the locked and unlocked positions.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards folding tables. The principles of the present invention, however, are not limited to folding tables. It will be understood that, in light of the present disclosure, the invention disclosed herein can be successfully used in connection with other types of tables, furniture and the like.

Additionally, to assist in the description of the folding tables, words such as top, bottom, front, rear, right and left may be used to describe the accompanying figures. It will be appreciated the folding tables can be disposed in other positions, used in a variety of situations and may perform a number of different functions. In addition, the drawings may be to scale and may illustrate various configurations, arrangements, aspects and features of the table. It will be appreciated, however, the table may have other suitable shapes, sizes, configurations and arrangements depending, for example, upon the intended use of the table. Further, the table may include any suitable number or combination of components, aspects, features and the like. A detailed description of exemplary embodiments of the folding table now follows.

Figure 1:
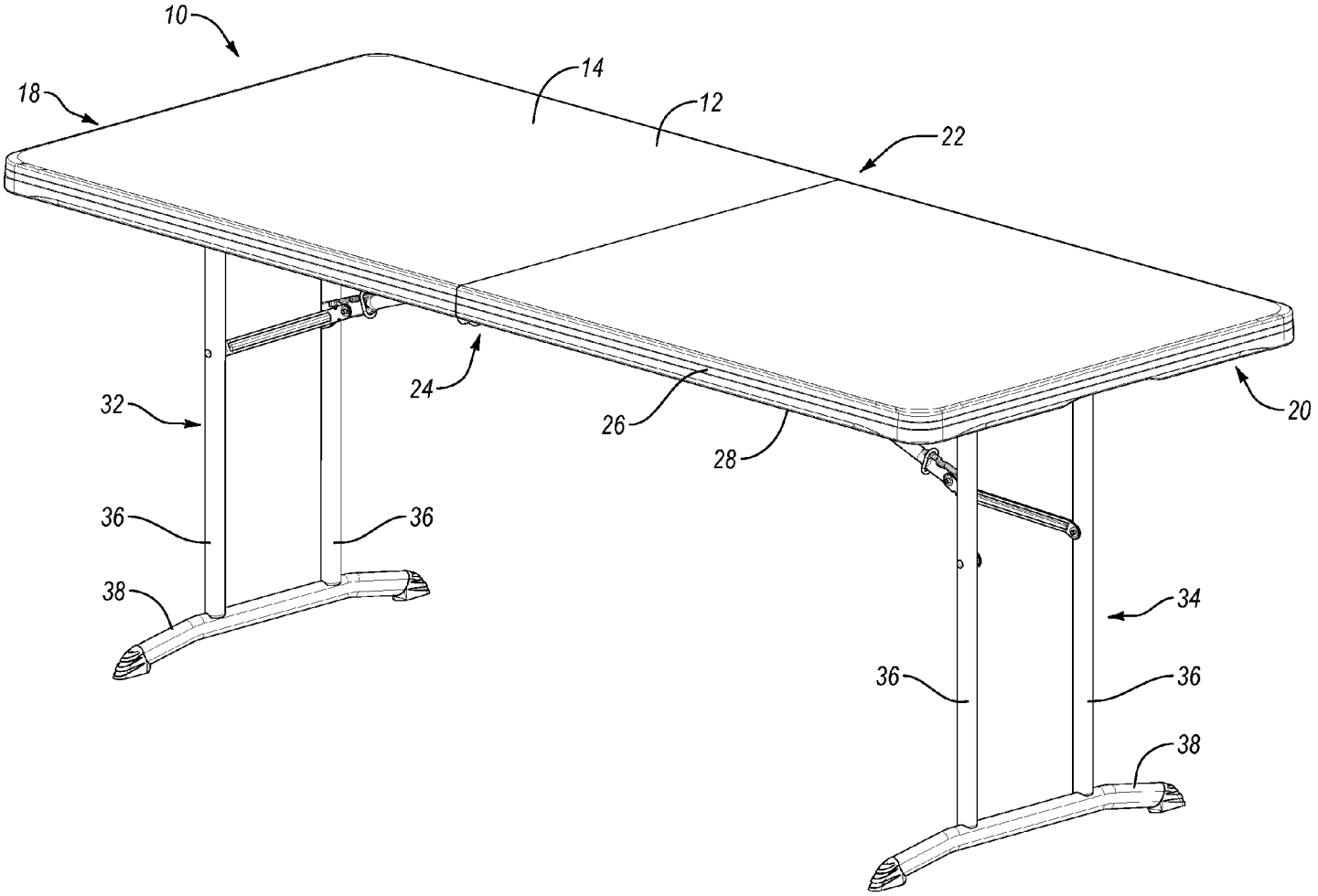
FIG. 1 is an upper perspective view of an exemplary table.

As shown in FIG. 1, the table 10 may include a table top 12 with an upper portion or surface 14, a lower portion or surface 16, a first end 18, a second end 20, a first side 22 and a second side 24. The upper surface 14 of the table top 12 is preferably generally planar to create a working surface, but the upper surface could also be textured and have other suitable configurations depending, for example, upon the intended use of the table. The table top 12 may also include an edge 26 that is disposed about the outer perimeter or periphery of the table top. All or a portion of the edge 26 may be beveled, sloped or rounded to, for example, increase the comfort and safety of the user. The table top 12 may also include a downwardly extending lip 28 disposed near or at least proximate an outer portion or perimeter of the table top. The lip 28 preferably extends downwardly relative to the lower surface 16 of the table top 12 and the lip may be aligned with or form a part of the edge 26 of the table top. It will be appreciated that the lip 28 may also be spaced inwardly from the edge 26 of the table top 12. It will also be appreciated that the table 10 and its various components may have other shapes, sizes, configurations and arrangements depending, for example, upon the intended use of the table 10. It will further be appreciated that the table 10 can include any suitable number of features, aspects and the like, such as disclosed in U.S. Pat. Nos. 6,530,331; 7,111,563; 7,475,643; 7,814,844; and 7,975,625; each of which are incorporated by reference in its entirety.

As shown in the accompanying figures, the table top 12 may have a generally rectangular configuration with rounded corners. The table top 12 may have a relatively large size and the table 10 may be configured for use as a banquet or utility table. For example, the table top 12 may have a length between about four feet and ten feet, including a length such as about five feet, about six feet, about eight feet and the like. The table top 12 may have a width between about two feet and about three feet, such as about two and one-half feet. One of ordinary skill in the art will appreciate, in view of this disclosure, the table top 12 could be larger or smaller. One skilled in the art will also appreciate the table top 12 could have other suitable shapes and configurations such as square, circular, oval and the like; and the sides, corners, edges and other portions of the table top could have various shapes, sizes, configurations and arrangements depending, for example, upon the intended use of the table 10. Further, the table 10 could be any suitable type of table such as a folding table, non-folding table, card table, personal table, round table and the like.

The table top 12 may be constructed from lightweight materials such as plastic. In particular, the table top 12 may be constructed from materials such as high-density polyethylene but other suitable plastics and types of materials could be used. The table top 12 may be constructed from blow-molded plastic which may allow a relatively strong, lightweight, rigid and sturdy table top to be quickly and easily manufactured. The blow-molded plastic table top 12 may be lightweight because it may include a hollow interior portion formed during the blow-molding process. The blow-molded plastic table top 12 may also be relatively durable, weather resistant, temperature insensitive, corrosion resistant, rust resistant and may not deteriorate over time. One of ordinary skill in the art will appreciate the table top 12 does not have to be constructed from blow-molded plastic and other suitable materials and/or processes can be used to construct the table top. For example, the table top 12 may be constructed from other types of plastics, polymers and synthetic materials; and different processes such as injection molding, rotational molding, rotary molding, etc. In addition, the table top 12 may be constructed from other materials with sufficient strength and desirable characteristics such as wood, metal, alloys, composites, fiberglass, ceramics and the like.

Figure 2:
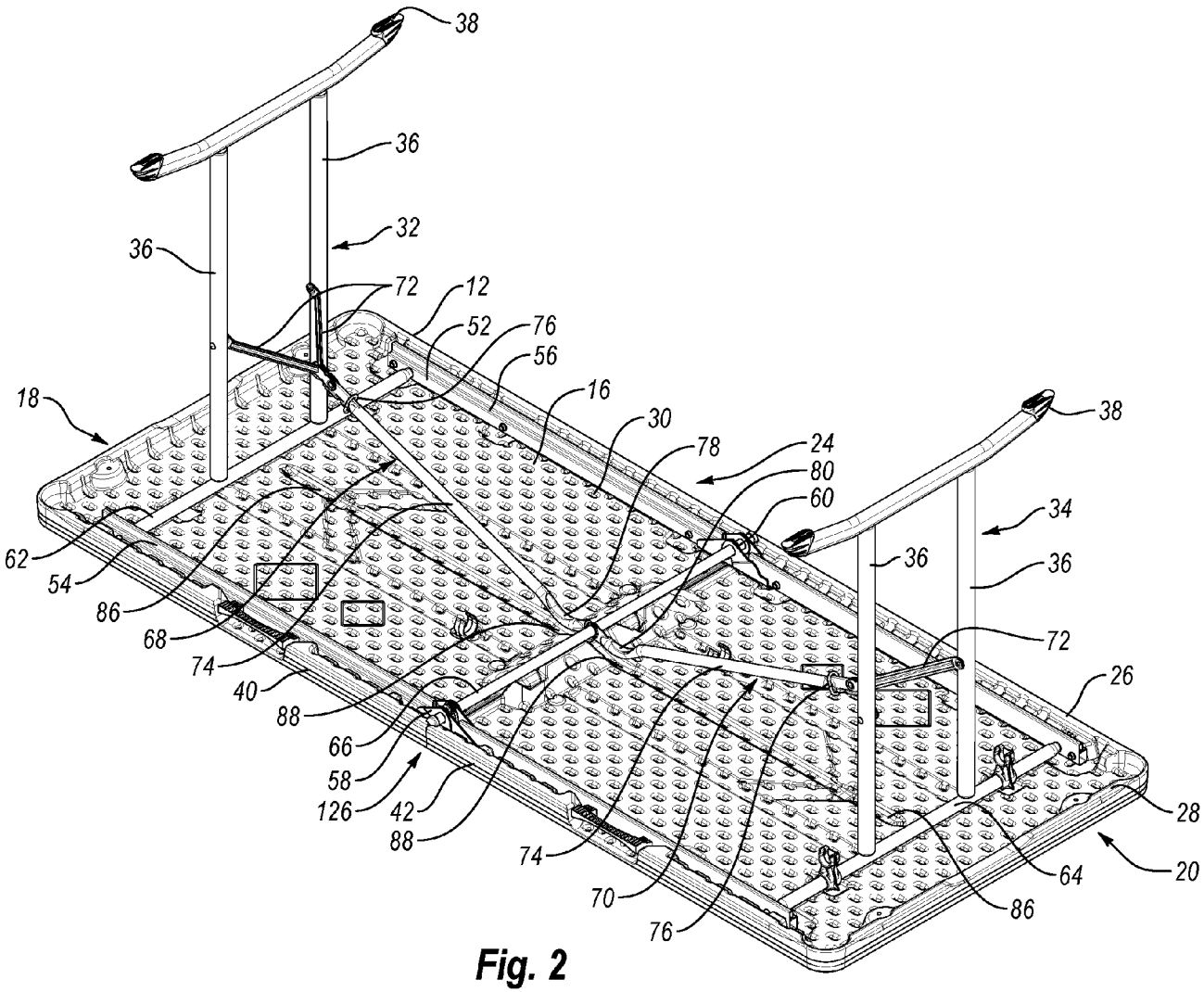
FIG. 2 is a lower perspective view of the table, illustrating exemplary support structures and cross braces in extended or use positions.
Figure 3:
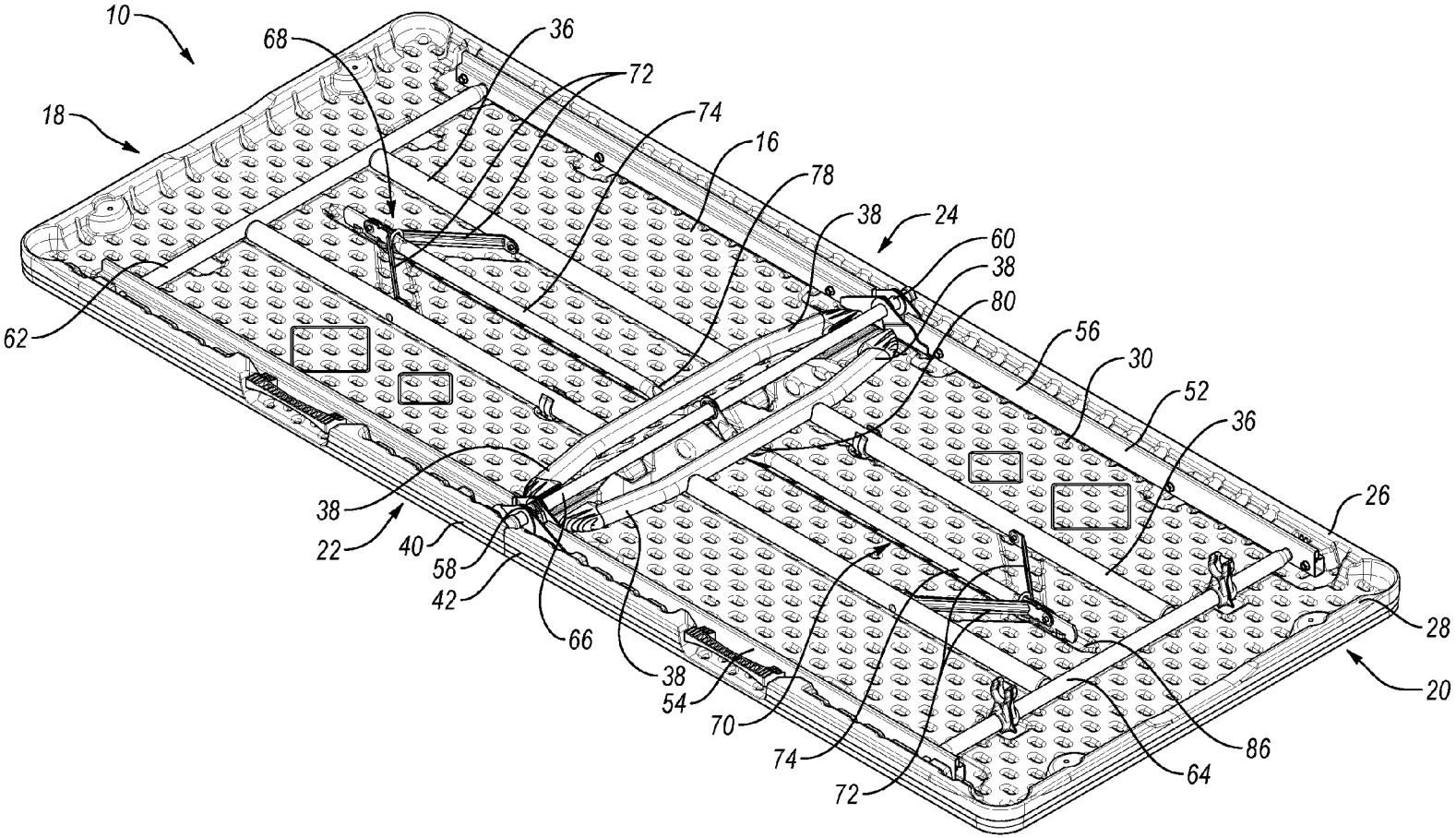
FIG. 3 is another lower perspective view of the table, illustrating the support structures and cross braces in collapsed or folded positions.

The table top 12 may include spaced apart outer walls, such as the upper and lower surfaces 14, 16, which may help create a strong and rigid table top. For instance, the upper and lower surfaces 14, 16 of the table top 12 may be separated by a generally constant distance and the surfaces may be generally aligned in parallel planes. As shown in FIGS. 2 and 3, for example, the table top 12 may also include one or more tack-offs, kiss-offs or depressions 30. The depressions 30 may be disposed in the lower surface 16 of the table top 12 and the depressions may be sized and configured to increase the strength, structural integrity and/or rigidity of the table top. The depressions 30 may also be used to create a table top 12 with more uniform properties and characteristics, and the depressions may cover a majority, substantially all or the entire lower surface 16 of the table top. Advantageously, the depressions 30 can be integrally formed with the table top 12 as part of a unitary, one-piece construction or structure, and the depressions may be formed in any desired portions of the table top. The depressions 30, and other portions of the table 10, may have other shapes, sizes, configurations, arrangements and features, such as disclosed in U.S. Pat. Nos. 7,069,865; 7,114,453; 7,143,702; and 7,210,277; and U.S. patent publication no. 2006-0230989; which are each incorporated by reference in its entirety.

The table 10 may include one or more support structures sized and configured to support the table top 12 above a surface. For example, the table 10 may include a first support structure 32 and a second support structure 34, and each support structure may include one or more legs or supports 36, and the legs may be connected by one or more connecting members and/or feet 38. The support structures 32, 34 may be movable between an extended or use position in which the legs 36 extend outwardly from the table top 12 and a collapsed or storage position in which the legs are disposed at least proximate the table top. The table 10 may include any suitable number, shape, size, configuration and arrangement of support structures 32, 34; legs 36; and/or feet 38 depending, for example, upon the intended use of the table.

Figure 4:
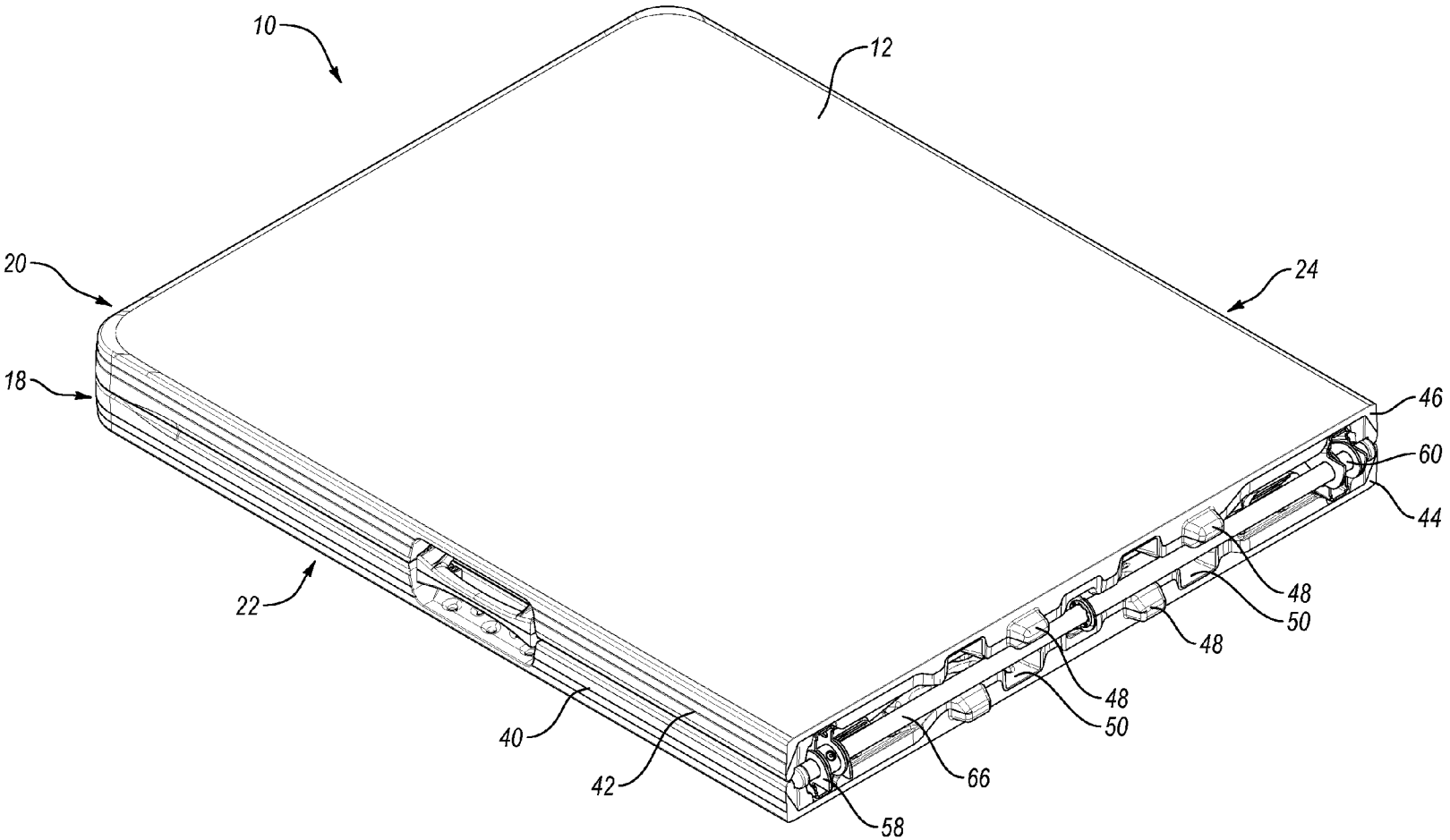
FIG. 4 is an upper perspective view of the table, illustrating the table in a folded position.

As seen in FIG. 4, the table 10 may be a fold-in-half table and the table top 12 may include a first section 40 and a second section 42. As shown in FIGS. 2 and 3, the first support structure 32 may be movable between extended and collapsed positions relative to the first section 40 of the table top 12. The second support structure 34 may be movable between the extended and collapsed positions relative to the second section 42 of the table top 12. In addition, the first and second sections 40, 42 of the table top 12 may be foldable about an axis between an unfolded position and a folded position. The first and second sections 40, 42 may be generally aligned in the same plane when the table top 12 is in the unfolded position, and the first and second table top sections may be disposed generally adjacent and parallel to each other when the table top is in the folded position.

As shown in the accompanying figures, the first and second sections 40, 42 of the table top 12 may have a generally rectangular configuration with a generally symmetrical or mirror-image configuration. In addition, the first section 40 of the table top 12 may include an inner surface 44 that is sized and configured to contact and/or engage an inner surface 46 of the second section 42 of the table top when the table 10 is in the unfolded position. The inner surfaces 44, 46 may be spaced apart when the table top 12 is in the folded position. As shown in FIG. 4, for example, the inner surfaces 44, 46 of the table top 12 may include one or more interlocking, overlapping and/or intertwined portions, such as an engaging portion 48 and a receiving portion 50, which may provide additional strength, stability and/or rigidity to at least the center portion of the table top. The table top 12 may also have other shapes, sizes, configurations and arrangements, such as shown in U.S. Pat. No. 7,096,799, which is incorporated by reference in its entirety.

As seen in FIGS. 2 and 3, for example, the table 10 may include a frame 52 connected to the table top 12 and the frame may include one or more elongated members or rails. In particular, a first side rail 54 may be disposed at least proximate the first side 22 of the table top 12 and this side rail may include a first portion connected to the first section 40 of the table top and a second portion connected to the second section 42 of the table top. A second side rail 56 may be disposed at least proximate the second side 24 of the table top 12 and this side rail may include a first portion connected to the first section 40 of the table top and a second portion connected to the second section 42 of the table top. While the side rails 54, 56 may be positioned at least proximate the sides 22, 24 of the table top 12 and may extend almost the entire length of the first and second portions 40, 42 of the table top 12, the side rails and/or the frame 52 may have other shapes, sizes, configurations and arrangements depending, for example, upon the intended use of the table 10. For example, the frame 52; side rails 54, 56 or table 10 could include one or more features or aspects as disclosed in U.S. Pat. No. 8,555,789, entitled Frame for a Folding Table, which is incorporated by reference in its entirety.

The first and second side rails 54, 56 of the frame 52 may be pivotally connected by first and second hinge assemblies 58, 60, respectively, to allow the table 10 to be moved between the folded and unfolded positions. In particular, the first hinge assembly 58 may be connected to the first side rail 54 and the second hinge assembly 60 may be connected to the second side rail 56. The first and second hinge assemblies 58, 60 may allow the first and second sections 40, 42 of the table top 12 to rotate about an axis of rotation when the table is folded and unfolded.

The frame 52 and the first support structure 32 may be connected by a first cross member 62, and the frame and the second support structure 34 may be connected by a second cross member 64. For example, the ends of the first and second cross members 62, 64 may be disposed in openings in the side rails 54, 56 of the frame 52 to allow the cross members to rotate relative to the frame. The cross members 62, 64 may also be connected to the frame 52, and the table 10 may include other features, such as shown in U.S. Pat. No. 7,100,518, which is incorporated by reference in its entirety. Advantageously, the cross members 62, 64 may form part of the frame 52 and/or the support structures 32, 34, depending, for example, upon the particular arrangement and/or configuration of the table 10.

A cross member 66 may be disposed at least proximate a center portion of the table top 12. The cross member 66 may be aligned with the axis of rotation of the table 10 between the folded and unfolded positions, and the cross member may be connected to the hinge assemblies 58, 60. As described in greater detail below, the cross member 66 may be rotatably coupled to the hinge assemblies 58, 60 and the cross member may rotate between one or more positions, such as a first position and a second position, relative to the hinge assemblies. The cross member 66 could also be connected to other suitable portions of the table 10. In addition, the cross member 66 may be disposed in a fixed position relative to the table top 12 or it may move relative to the table top, and the cross member may also be disposed in one or more receiving portions. These and other features that may be used in connection with the table 10 are disclosed in U.S. Pat. Nos. 8,397,653 and 8,573,139, which are each incorporated by reference in its entirety.

As best seen in FIGS. 2 and 3, a first cross brace 68 may be connected the cross member 66 and the first support structure 32, and a second cross brace 70 may be connected the cross member 66 and the second support structure 34. The first and second cross braces 68, 70 may include a pair of arms 72 pivotally connected to the legs 36 and an elongated body 74 connected to the cross member 66. The arms 72 and the elongated body 74 may be pivotally connected and a locking member, such as a locking ring 76, may be used to secure the cross braces 68, 70 in an extended position.

Figure 5:
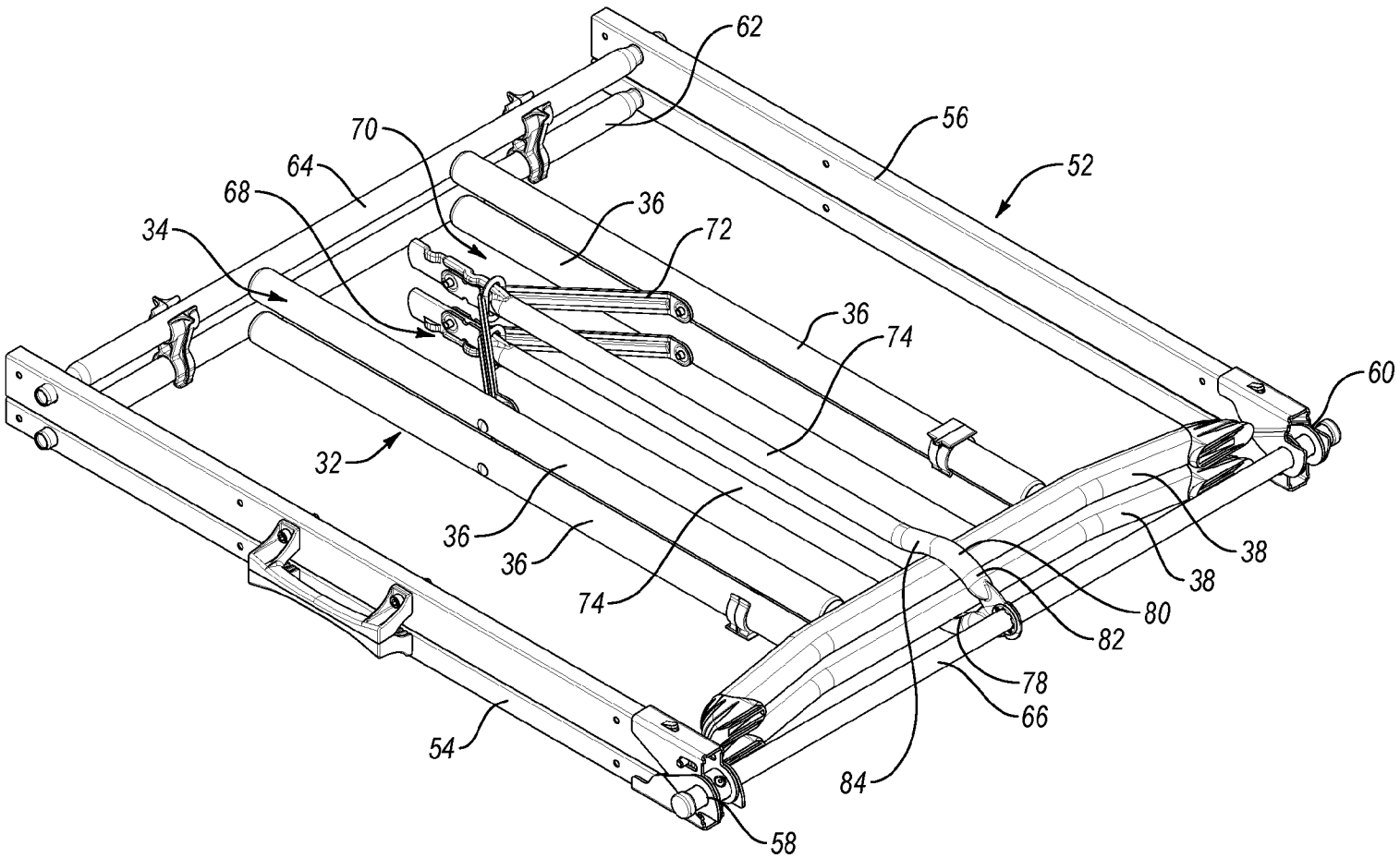
FIG. 5 is an upper perspective view of an exemplary frame for a table, illustrating the frame in a folded position.

The body 74 of the cross braces 68, 70 may include one or more curved, bent or angled sections, which may facilitate folding of the table 10. For example, as shown in FIGS. 2 and 3, the first cross brace 68 may include a first foot receiving portion 78 and the second cross brace 70 may include a second foot receiving portion 80. As shown in FIG. 5, when the table 10 is folded, the feet 38 may be disposed in the foot receiving portions 78, 80. In addition, as shown in FIG. 3, when the support structures 32, 34 are in the collapsed positions, the feet 38 may be aligned with the body 74 of the cross braces 68, 70. In particular, the portion of the foot 38 disposed in the foot receiving portions 78, 80 may be generally aligned with an axis extending through the elongated body 74 of the cross braces 68, 70. Advantageously, this may allow the table 10 to have a compact size in the folded position.

In greater detail, the first and second foot receiving portions 78, 80 may include a first curved, bent or angled section 82 and a second curved, bent or angled section 84. The first curved portion 82 preferably extends towards the lower portion 16 of the table top 12 and the second curved portion 84 preferably extends away from the lower portion of the table top. The table top 12 may include a first receiving portion 86 that extends a first distance into the lower portion 16 of the table top. The first receiving portion 86 may be sized and configured to receive at least a portion of the body 74 of the cross braces 68, 70 when the support structures 32, 34 are in the collapsed position. The table top 12 may also include a second receiving portion 88 that extends a second distance into the table top and is sized and configured to receive the foot receiving portions 78, 80 when the support structures 32, 34 are in the collapsed position. The second receiving portion 88 may have a larger height and extend further into the lower portion 16 of the table top 12 than the first receiving portion 86 to accommodate the first and second foot receiving portions 78, 80.

As mentioned above, the elongated body 74 of the first and second cross braces 68, 70 may be connected to the cross member 66. For example, an end of the elongated body 74 may include an opening and the cross member 66 may be disposed in the opening. Preferably, one of the cross braces 68, 70 is connected to the cross member 66 such that movement of the cross brace causes movement of the cross member. For instance, the end of the second cross brace 70 may be secured to the cross member 66 such that movement of the second cross brace causes the cross member to rotate. Thus, the second cross brace 70 may be secured to the cross member 66 in a fixed position. The cross member 66, however, may freely rotate or pivot relative to the first cross brace 68. Therefore, movement of the second cross brace 70 may cause the cross member 66 to rotate but movement of the first cross brace 68 may not cause the cross member to rotate or move. It will be appreciated that either cross brace 68, 70 may be rotatably or non-rotatably connected to the cross member 66 and the cross braces may be connected to other portions of the table 10. The table 10 may also have other suitable arrangements and configurations such as two or more cross members and the cross braces 68, 70 may be connected to different cross members and/or other portions of the table top 12. In addition, it will be appreciated the cross members 62, 64, 66 and cross braces 68, 70 may have other suitable shapes, sizes, configurations and arrangements depending, for example, upon the intended use of the table 10. It will also be appreciated that the first and second foot receiving potions 78, 80; the first and second curved sections 82, 84; and the first and second receiving portions 86, 88 may have other shapes, sizes, configurations and arrangements depending, for example, upon the size and configuration of the table 10.

In greater detail, the second cross brace 70 may be connected to the cross member 66 such that movement of the second support structure 34 causes movement of the cross member. For instance, as the second support structure 34 is moved between the extended and collapsed positions, the second cross brace 70 may cause the cross member 66 to rotate. In particular, movement of the second support structure 34 from the collapsed to the extended position may cause the cross member 66 to rotate in a first direction, such as clockwise, and movement of the second support structure from the extended to the collapsed position may cause the cross member to rotate in a second direction, such as counterclockwise. The first cross brace 68, however, may be connected to the cross member 66 in a manner so that movement of the first support structure 32 does not cause movement of the cross member. It will be understood that either or both of the support structures 32, 34 may be used to move or rotate the cross member 66 depending, for example, upon the design or configuration of the table 10.

Figure 6A:
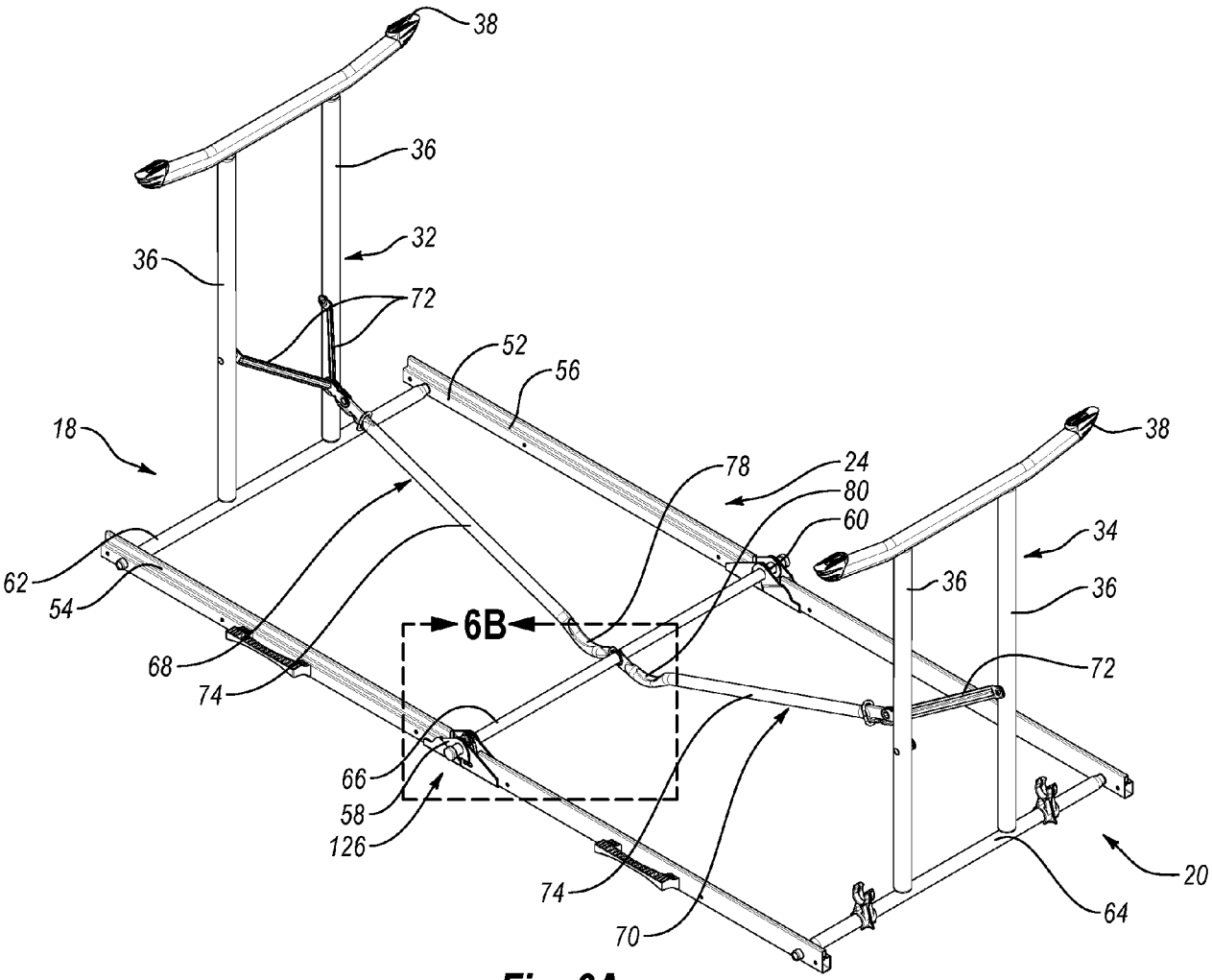
FIG. 6A is a perspective view of the frame, illustrating the frame in an unfolded position, and the support structures and cross braces in extended or use positions.
Figure 6B:
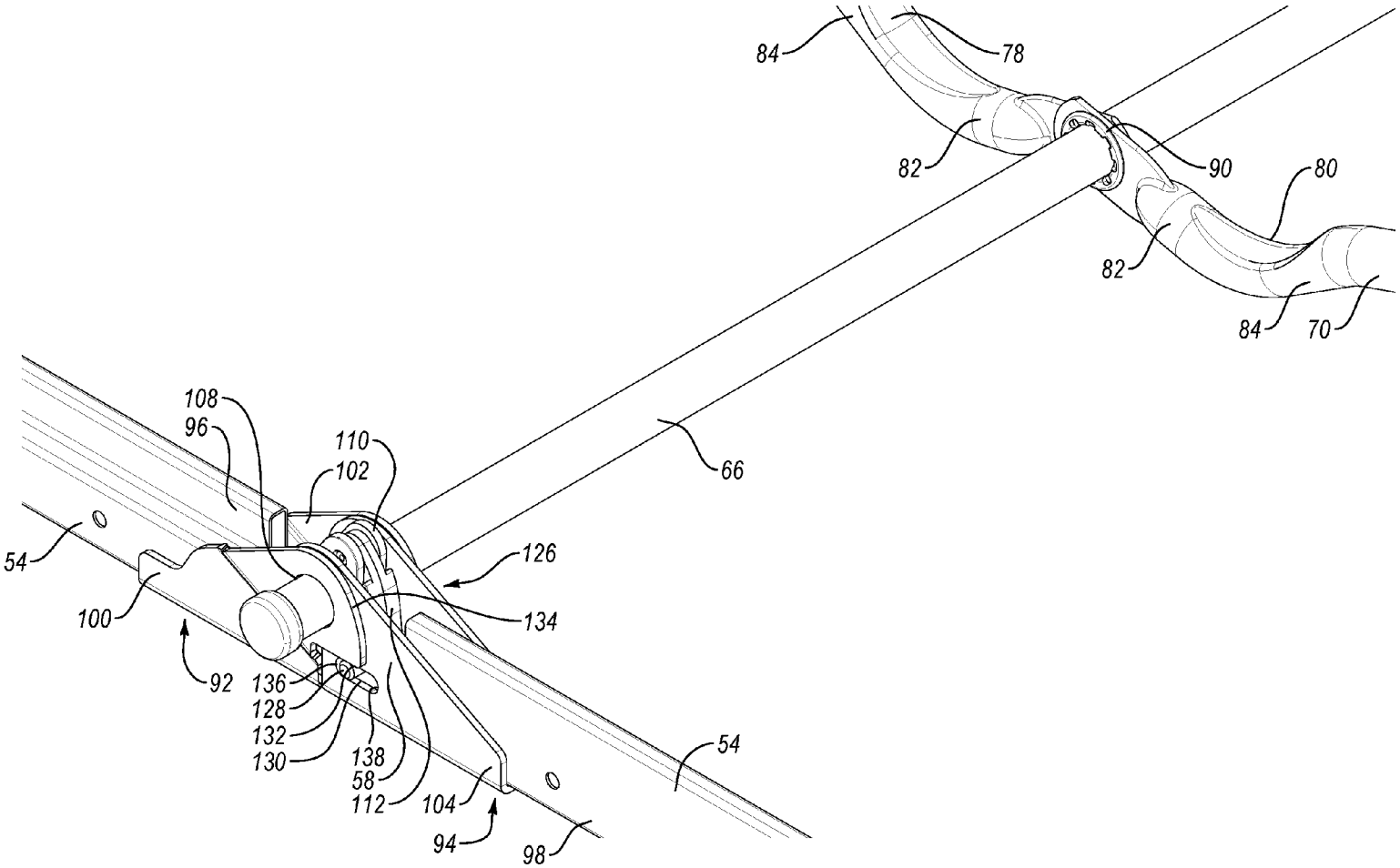
FIG. 6B is an enlarged perspective view of a portion of the frame shown in FIG. 6A along lines 6B-6B, illustrating the frame in an unfolded position and a locking mechanism in a locked position.
Figure 7A:
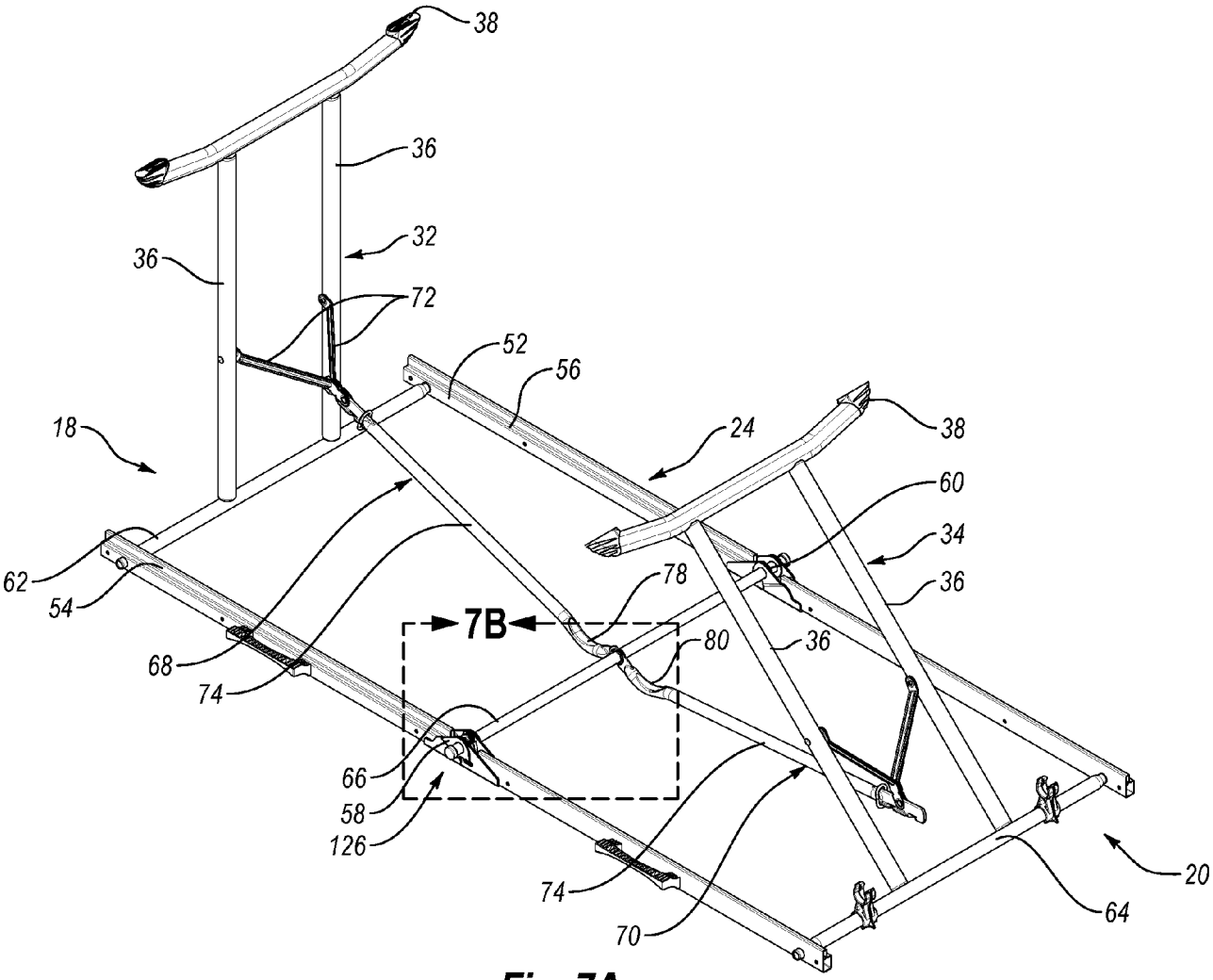
FIG. 7A is another perspective view of the frame, illustrating the locking mechanism in an unlocked position, and a cross brace and a support structure in a partially collapsed or folded position.
Figure 7B:
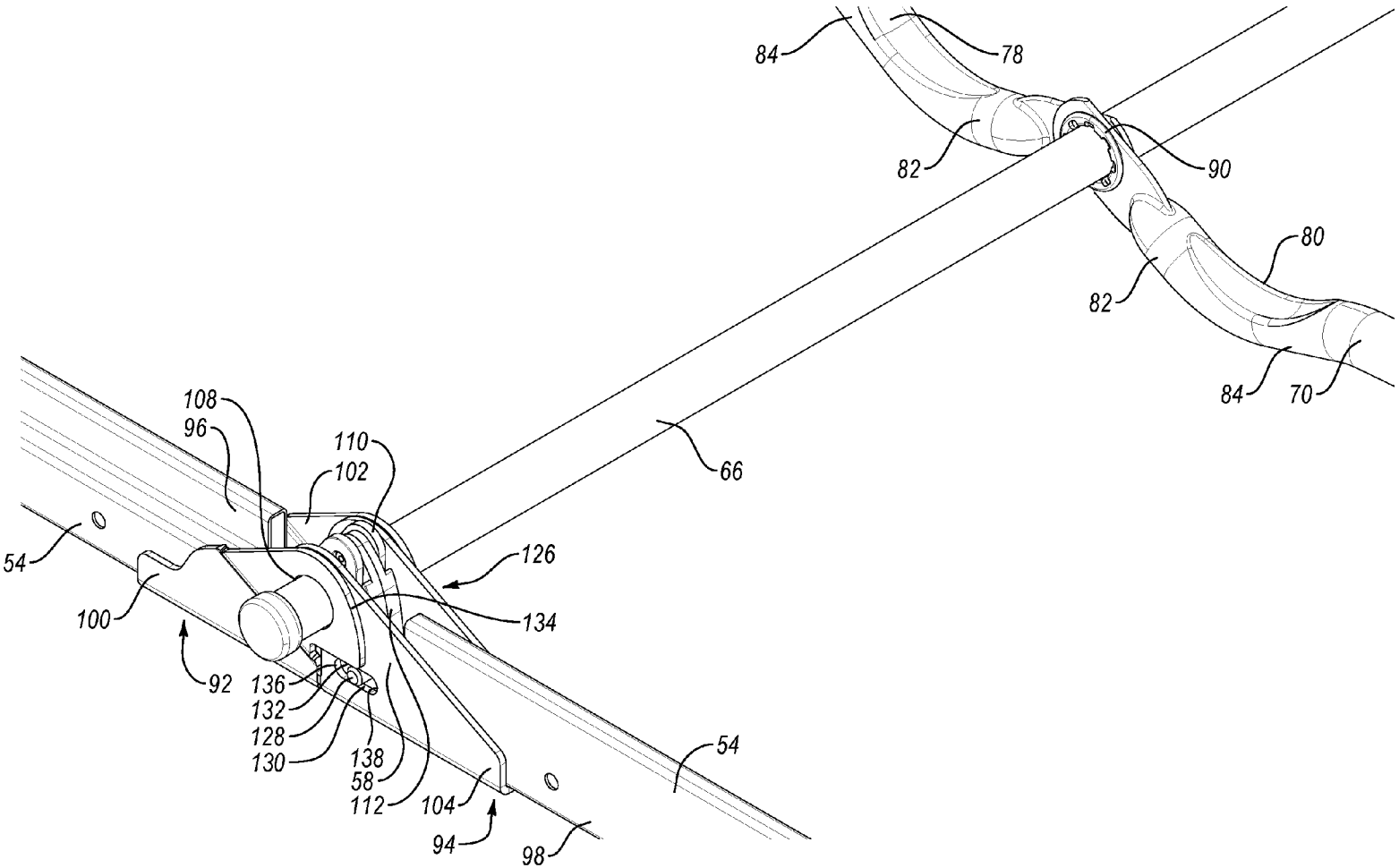
FIG. 7B is an enlarged perspective view of a portion of the frame shown in FIG. 7A along lines 7B-7B, illustrating the locking mechanism in a partially unlocked position.
Figure 8A:
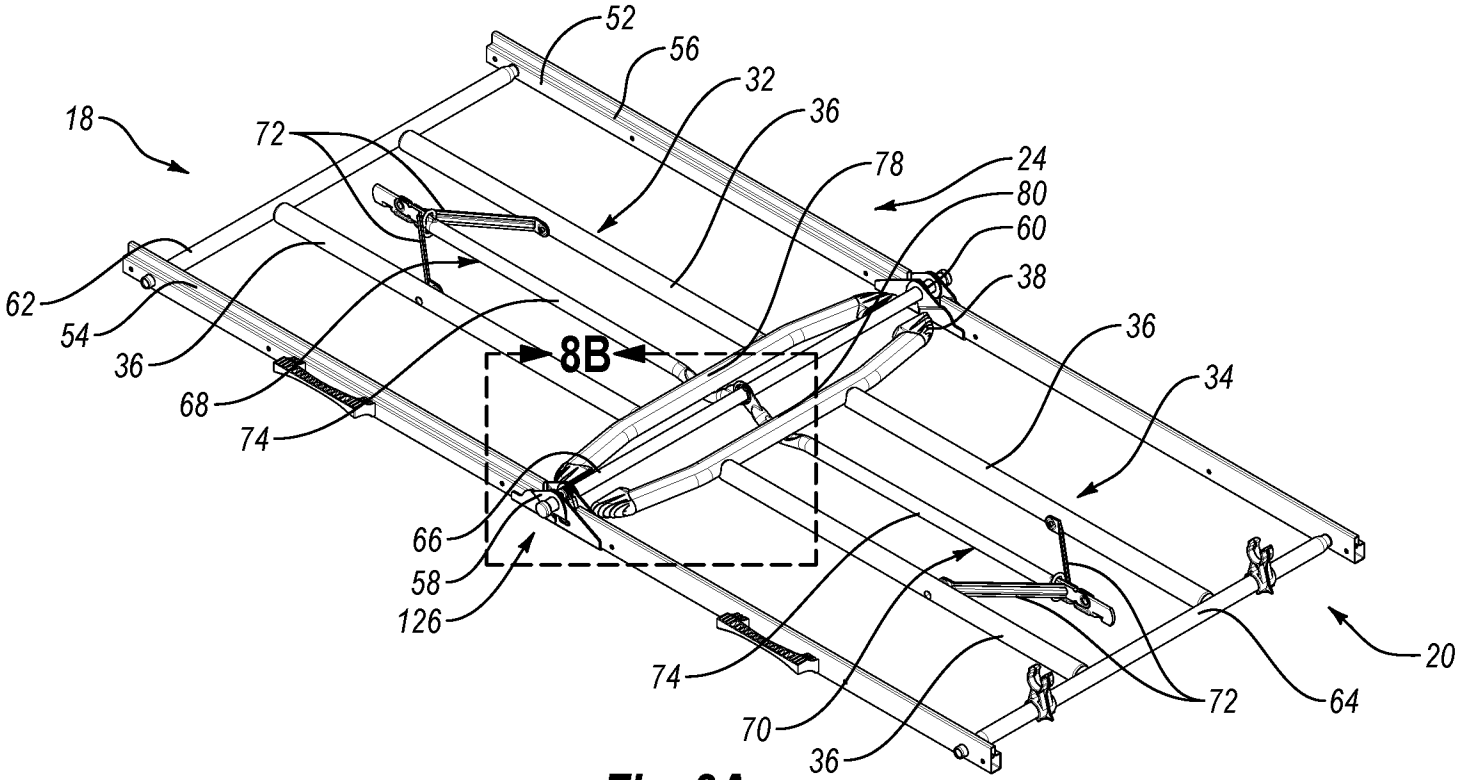
FIG. 8A is still another perspective view of the frame, illustrating the locking mechanism in an unlocked position, and the cross brace and the support structure in a collapsed or folded position.

As shown in FIGS. 6A and 6B, the ends of the first and second cross braces 68, 70 may be connected to the cross member 66 and may be disposed at least adjacent to each other. In addition, one or more sleeves 90 may be used to facilitate connection of the cross braces 68, 70 and the cross member 66. For example, the sleeve 90 may be used to connect the second cross brace 70 such that movement of the second support structure 34 causes movement of the cross member 66 and/or the sleeve may be used to allow the first support structure 32 to move without causing movement of the cross member. It will be appreciated that the cross member 66 and the cross braces 68, 70 may be connected in other suitable fashions such as by welding, adhesives, couplings, braces and the like. Further, as seen in FIG. 8, the first and second cross braces 68, 70 may be connected to the cross member 66 using other suitable structures, such as a connecting member, and the cross braces may be rotatably and/or non-rotatably attached to the connecting member.

The cross member 66 may be coupled to the hinge assemblies 58, 60 as shown in FIGS. 6A and 6B. In particular, the first hinge assembly 58 may include a first bracket 92 connected to a first portion 96 of the first side rail 54 and a second bracket 94 connected to a second portion 98 of the first side rail. The first bracket 92 may include a first pair of flanges 100, 102 and the second bracket 94 may include a second pair of flanges 104, 106. The end of the cross member 66 may be inserted through one or more apertures 108 in the flanges 100, 102, 104 and/or 106. Thus, the cross member 66 may pivotally connect the first and second brackets 92, 94 of the hinge assembly 58, the cross member may be rotatable relative to the brackets, the cross member may be aligned with an axis of rotation of the hinge assembly 58, and/or the table 10 may fold and unfold along this axis of rotation.

As shown in FIGS. 6A-8B, at least a portion of a first connector 110 may be connected to the cross member 66 by means such as a fastener, adhesives, interference fit and the like. The first connector 110 may be sized and configured to be connected to a second connector 112. In particular, the first and second connectors 110, 112 may be pivotally connected. For example, the first connector 110 may include one or more openings or apertures 114 and the cross member 66 may be at least partially disposed within one or more of the openings. A fastener, such as a screw or rivet, may be inserted into an opening 116 to connect the connector 110 to the cross member 66. In addition, the first connector 110 may include openings 118 that are sized and configured to facilitate connection to the second connector 112. For example, the second connector 112 may include outwardly extending protrusions or projections 120 that are sized and configured to pivotally connect the first and second connectors 110, 112.

The first and second connectors 110, 112 may have one or more engagements surfaces, which may be curved or cam shaped, and the surfaces may contact or touch. The engagement surfaces may be used to help control movement of the first and second connectors 110, 112. For example, the first connector 110 may include an engagement surface 122 and the second connector 112 may include an engagement surface 124. The engagement surfaces 122, 124 may be sized and configured to facilitate movement of the first and second connectors 110, 112. For example, when the cross member 66 moves or rotates, the first and second connectors 110, 112 may also move and the engagement surfaces 122, 124 may allow and/or help control movement of the connectors.

The first and second connectors 110, 112 may be at least partially disposed proximate the hinge assemblies 58, 60. For instance, as shown in the accompanying figures, the first and second connectors 110, 112 may be at least substantially disposed between the flanges 100, 102, 104 and/or 106 of the first and second brackets 92, 94 of the hinge assembly. Advantageously, this positioning may help protect the connectors 110, 112 from damage and/or position the connectors in a desired location or arrangement. This positioning may also facilitate positioning and/or attaching the cross member 66, the first connector 110 and the second connector 112. It will be understood that any suitable number, size, shape, configuration and arrangement of connectors 110, 112 may be used and the connectors may be positioned in other desired locations.

The first and second connectors 110, 112 may be connected to and/or form part of a locking mechanism 126, which may lock the table 10 and/or the table top 12 in a desired position. For example, the locking mechanism 126 may lock the table top 12 in an unfolded or use position. The locking mechanism 126 may also unlock the table top 12 so that the table top is capable of being moved between the use and collapsed positions. In greater detail, the locking mechanism 126 may be sized and configured to lock a hinge assembly, such as the hinge assemblies 58, 60 in a fixed position, which may prevent folding of the table top 12. Advantageously, the locking mechanism 126 may simultaneously lock and unlock the hinge assemblies 58, 60. The locking mechanism 126, however, may lock and/or unlock any desired number of hinge assemblies or other devices. The locking mechanism 126 may also lock the hinge assemblies and/or table top in other positions such as a collapsed or folded position.

The locking mechanism 126 may include a locking member 128, such as a pin, that is disposed within an opening 130, such as a slot. As shown in FIG. 6B, for example, the opening 130 may be disposed in the flange 104 of the second bracket 94. The locking member 128 may be movable within the opening 130 between a first position in which the locking member locks the hinge assembly 58 and a second position in which the hinge assembly is unlocked. As shown in the accompanying figures, the locking member 128 may have a generally cylindrical configuration, which may facilitate movement within the opening 130 and between the locked and unlocked positions. The locking member 128 may also have other suitable shapes, sizes, configurations and arrangements depending, for example, upon the configuration of the hinge assembly 58 and/or the slot 130.

In greater detail, a slot 130 may be disposed in the flange 104 of the bracket 94 and the flange 100 of the other bracket 92 may include a receiving portion or engagement surface 132 and a curved or cam surface 134. The engagement surface 132 is preferably sized and configured to abut, contact or engage the locking member 128 when the locking member is in the locked position. The contact between the locking member 128 and the engagement surface 132 may prevent the hinge assembly 58 from closing or folding. The cam surface 134 may contact and/or be spaced apart from the locking member 128 when the locking member is in the unlocked position, which may allow the hinge assembly 58 to be opened or closed. In addition, the curved or cam surface 134 may help maintain the locking member 128 in the unlocked position, which may facilitate folding and unfolding the table top 12 and/or the table 10. Thus, when the locking member 128 of the locking mechanism 126 is in the locked position, it may contact the engagement surface 132 to prevent the hinge assembly 68 from closing. On the other hand, when the locking member 128 is in the unlocked position, it may not contact the engagement surface 132 and the hinge assembly 58 may be opened or closed. This may allow the table top 12 to be readily moved between the folded and unfolded configurations.

Figure 8B:
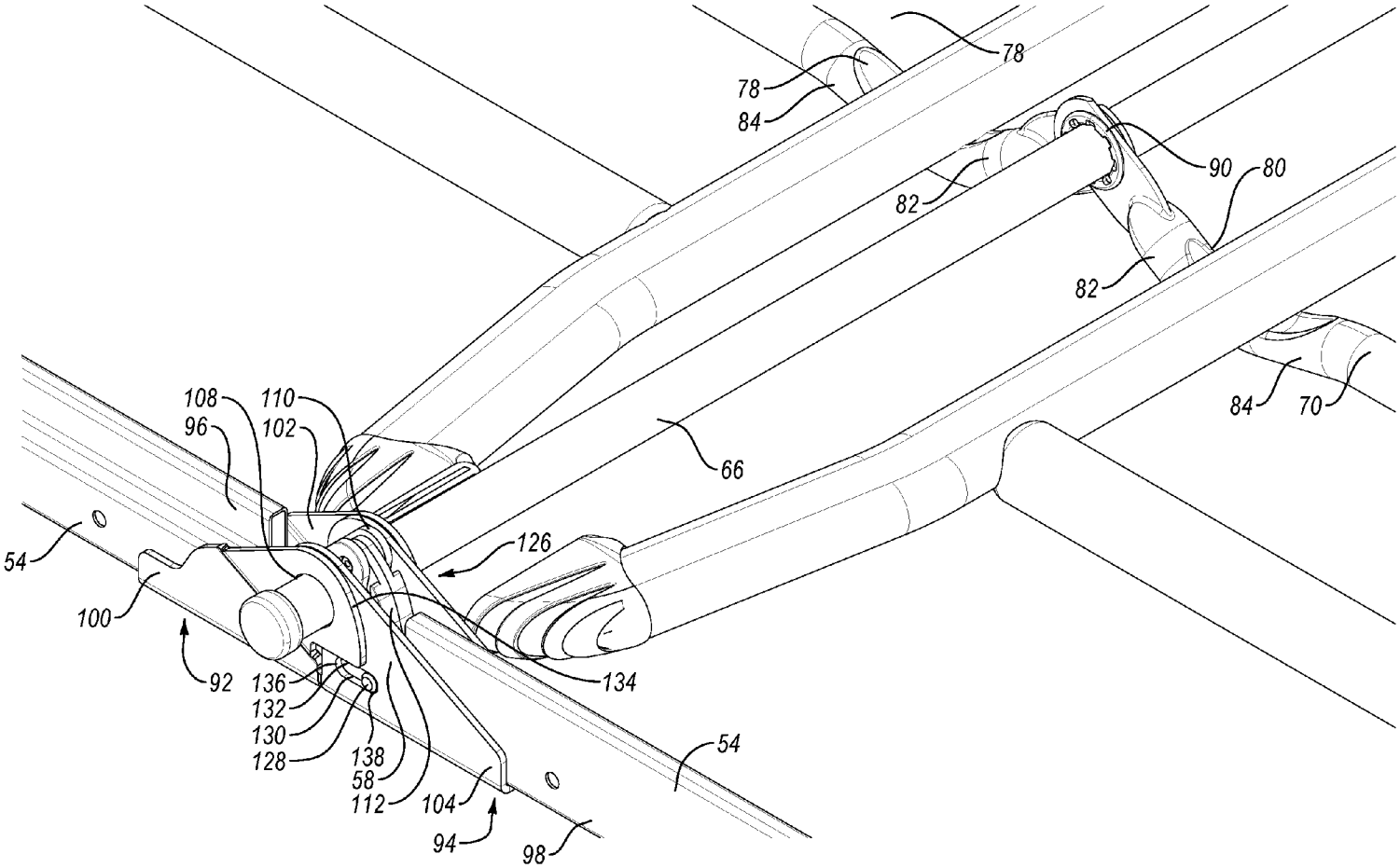
FIG. 8B is an enlarged perspective view of a portion of the frame shown in FIG. 8A along lines 8B-8B, illustrating the locking mechanism in an unlocked position.

As shown in FIG. 6B, the locking member 128 may engage the engagement surface 124 to secure the hinge assembly 58 in the open position. In this exemplary configuration, the locking member 128 may be disposed towards a first end 136 of the slot 130 and this may be referred to as the locked position because the engagement of the locking member with the engagement surface 132 may lock the hinge assembly 58 in a fixed position. As shown FIG. 7B, the locking member 128 may move within the slot 130. For example, the locking member 128 may move between the first end 136 of the slot 130 and a second end 138 of the slot 130. As shown in FIG. 8B, the locking member 128 may be disposed at least proximate the second end 138 of the slot 130 so that the locking member does not contact the engagement surface 132, which may allow the hinge assembly 58 to be moved or closed. This may be referred to as the unlocked position because the locking member 128 does not engage the engagement surface 132 and that may allow the hinge assembly 58 to be moved or closed. When the locking member 128 is the unlocked position, the locking member may also be spaced apart from and/or contact the cam surface 134 when the hinge assembly 58 is being opened or closed. The locking mechanism 126, the locking member 128, the slot 130, the engagement surface 132 and the cam surface 138 may also have other suitable shapes, sizes, configurations and arrangements depending, for example, upon the intended use of the table 10.

Advantageously, the interconnection of the support structures 32, 34; the cross member 66; the cross braces 68, 70; and the locking mechanism 126 may allow movement of the support structures to lock the table top 12 in the use position. In addition, movement of the support structures 32, 34 may unlock the table top 12 and allow the table top to be folded and unfolded. For example, moving the second support structure 34 from the collapsed to the extended position may cause the second cross brace 70 to move from the collapsed to the extended position, which may cause the cross member 66 to rotate, and that may rotate the first and second connectors 110, 112 and move the locking member 128 within the slot 130 to the locked position. On the other hand, moving the second support structure 34 from the extended to the collapsed position may cause the second cross brace 70 to move from the extended to the collapsed position, which may rotate the cross member 66 and the first and second connectors 110, 112, and that may move the locking member 128 within the slot 130 into the unlocked position. This may beneficially allow locking and unlocking of the hinge assembly 58 to be controlled by movement of the support structures 32, 34.

In greater detail, as shown in the accompanying figures, the cross member 66 may be disposed in a first position. When the cross member 66 is in the first position, the second support structure 34 may be in the extended position. As the second support structure 34 is moved from the extended to the collapsed position, the cross member 66 may move or rotate from the first position to a second position. For example, when the support structure 34 is in the collapsed position, the cross member 66 may be disposed in a second position. Advantageously, the movement or rotation of the cross member 66 may move the first connector 110 in a first direction and the second connector 112 in a second direction, which may cause the locking member 128 to move within the slot 130 between the locked position and the unlocked position. Thus, when the support structure 34 is in the collapsed position, the locking mechanism 126 may be unlocked and the cross member 66 may be in the second position. When the support structure 34 is moved from the collapsed to the extended position, that may cause the cross member 66 to rotate from the second position to the first position and move the locking mechanism 126 into the locked position. Consequently, movement of the support structure 34 may control movement or rotation of the cross member 66 and locking of the locking mechanism 126, which may facilitate use of the table 10. It will be appreciated that movement of the table top 12 and/or the frame 52 between the folded and unfolded positions may also be used to lock and unlock the locking mechanism 126.

Figure 9:
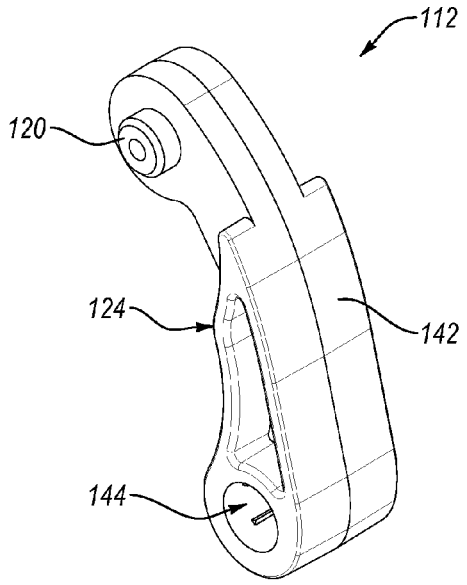
FIG. 9 is a perspective view of an exemplary connector that may be used in connection with the table, the connector may be part of the locking mechanism and may be connected to a cross member of a table.
Figure 10:
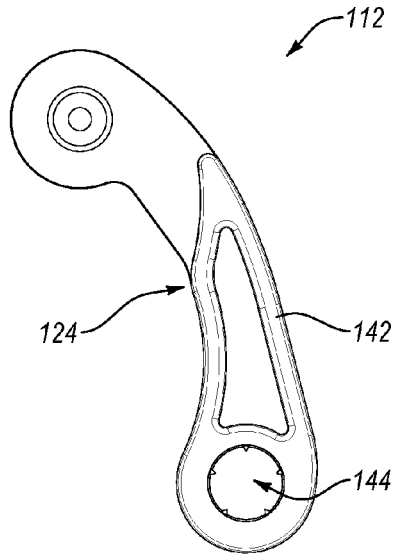
FIG. 10 is a side view of the connector shown in FIG. 9.
Figure 11:
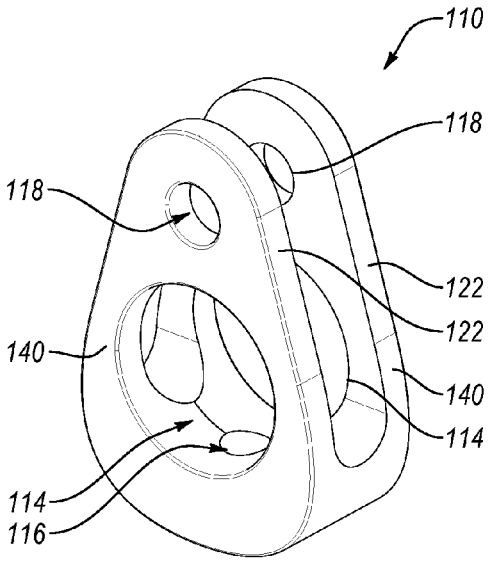
FIG. 11 is a perspective view of another exemplary connector that may be used in connection with the table, the connector may be part of the locking mechanism and may be connected to a locking member.
Figure 12:
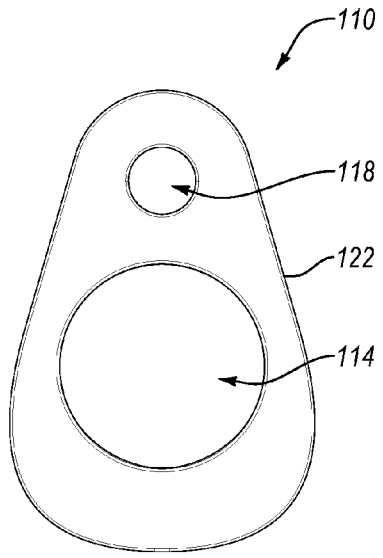
FIG. 12 is a side view of the connecting member shown in FIG. 11.

FIGS. 9-12 illustrate exemplary connectors that may be used in connection with the table. For example, FIGS. 11 and 10 illustrate an exemplary first connector 110 and it may include a pair of flanges 140 that are spaced apart by a distance. As shown in the accompanying figures, the first connector 110 may include a first pair of generally aligned apertures 114 that are sized and configured to receive the cross member 66 and a second aperture 116 that may be sized and configured to receive a fastener (not shown). This may allow the first connector 110 to be disposed about the cross member 66 and the fastener may secure the first connector and the cross member in a fixed position. The first connector 110 may also include a second pair of aligned apertures 118 in the flanges 140 that may allow the first connector to be pivotally connected to the second connector 112.

An exemplary embodiment of the second connector 112 is shown in more detail in FIGS. 9 and 10. The second connector 112 may include a first portion that is sized and configured to be connected to the first connector 110. As discussed above, the second connector 112 may include protrusions or engaging members 120 that are sized and configured to be disposed in the openings 118 in the first connector 110. The first and second connectors 110, 112 may also include one or more engagement, alignment and/or cam surfaces that are sized and configured to allow and/or facilitate movement of the connectors. For example, the first connector 110 may include engagement surfaces 122 and the second connector 112 may include engagement surface 124. Advantageously, the engagement surfaces 122, 124 may help align and position the connectors 110, 112. The second connector 112 may include a body 142, which may be elongated, and an opening or aperture 144 that is sized and configured to receive the locking member 128. In particular, one portion of the locking member 128 may be disposed in the opening 144 in the second connector 112 and another portion of the locking member may be disposed in the slot 130. One of ordinary skill in the art may appreciate after reviewing this disclosure that the first connector 110, the second connector 112 and the locking mechanism 126 may have other suitable shapes, sizes, configurations and arrangements depending, for example, upon the configuration and/or intended use of the table 10.

As shown in the accompanying figures, for example, the connectors 110, 112 and the locking mechanism 126 may be connected to the first side rail 54 of the frame 52. It will be appreciated that the connectors 110, 112 and the locking mechanism 126 may be connected to the second side rail 56 of the frame 52 and/or both side rails depending, for example, upon the intended use of the table 10. For example, in some instances, a locking mechanism 126 may be disposed on both sides of the table top 12. In other instances, a single locking mechanism 126 may be used. Thus, it will be appreciated that any suitable number of locking mechanisms 126 may be used. It will also be appreciated that any number, size, shape, configuration and arrangement of connectors 110, 112 may be used to connect the cross member 66 and the locking mechanism 126.

The connectors 110, 112 may be constructed from injection molded plastic and the locking member 128 may be constructed from relatively strong and rigid materials such as metal or steel. The support structures 32, 34 and frame 52 may also be constructed from metal or steel, which may easily be formed into the desired configuration by known operations such as stamping and bending. It will be appreciated that while the support structures 32, 34, the frame 52 and the locking member 128 may be constructed from metal, and the table top 12 may be constructed from blow-molded plastic, these and other portions of the table 10 may be constructed from other materials and processes. It will also be appreciated that various features of the table 10, such as the support structures 32, 34, the frame 52, and the locking mechanism 126, may have other suitable shapes, sizes, configurations and arrangements depending, for example, upon the size and shape of the table top 12 and/or the intended use of the table 10.

In operation, the table 10 may be disposed in a folded configuration, as shown in FIG. 4. The table top 12 may be unfolded, as shown in FIG. 3, and the first and second support structures 32, 34 may be moved from the collapsed to the use position, as shown in FIG. 2. Advantageously, when one or both of the support structures 32, 34 are moved from the collapsed to the use position, the table top 12 may be locked in the use position. In particular, for example, when the second support structure 34 is moved from the collapsed to the use position, the second support structure may cause the second cross brace 70 to move from the collapsed to the extended position. The movement of the cross brace 70 may cause the cross member 66 to rotate from a first position to a second position, and this may move the locking member 128 from the unlocked to the locked position. Specifically, the rotation of the cross member 66 may cause the first and second connectors 110, 112 to rotate, and that may cause the locking member 128 to move within the slot 130. Advantageously, this may allow the table top 12 to be automatically locked in the unfolded position when the second support structure 34 is moved into the extended position. When the table 10 is no longer desired to be used or moved, the second support structure 34 may be moved from the extended to the collapsed position and that may unlock the locking mechanism 126 by moving the locking member 128 from the locked to the unlocked position. When the locking member 128 is no longer disposed in the locked position, then the table top 12 can be moved between the folded and unfolded positions.

One of ordinary skill in the art may appreciate after reviewing this disclosure that the table 10; the table top 12; the support structures 32, 34; the frame 52; the hinge assemblies 58, 60; the cross members 62, 64, 66; the cross braces 68; the locking mechanism 126 and the like may have other suitable shapes, sizes, configurations and arrangements depending, for example, upon the intended use of the table 10.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A locking mechanism sized and configured to be used with a folding table, the folding table including a table top with a first section and a second section that are capable of being folded and unfolded, the table including a hinge assembly connecting the first and second sections of the table top, the folding table including at least one support structure sized and configured to support the table top above a surface, the support structure movable between a use position and a collapsed position, the folding table including a rotatable member rotatable between a first position and a second position relative to the table top, the folding table including a cross brace connecting the rotatable member and the support structure, the rotatable member rotating between the first and second positions when the support structure is moved between the use and collapsed positions, the locking mechanism comprising:

a first connector sized and configured to be connected to the rotatable member of a folding table, the first connector including an outwardly extending portion, the first connector movable between a first position and a second position, the rotation of the rotatable member between the first and second positions causing the first connector to move between the first and second positions;

a second connector pivotally connected to the outwardly extending portion of the first connector, the second connector movable between a first position and a second position, the movement of the first connector between the first and second positions causing the second connector to move between the first and second positions; and a locking member connected to the second connector, the locking member movable between a locked position to secure the folding table in a fixed position and an unlocked position to allow the table to be folded and unfolded, the movement of the second connector between the first and second positions causing the locking member to move between the locked and unlocked positions.

2. The locking mechanism as in claim 1, wherein the rotatable member is a cross member that is sized and configured to be disposed at least proximate a center portion of the folding table;

wherein the first connector is sized and configured to be connected to the rotatable member of the folding table in a fixed position; and wherein the second connector is pivotally connected to the first connector.

3. The locking mechanism as in claim 1, wherein movement of the support structure of the folding table between the use and collapsed positions causes the cross brace and the rotatable member to move;

wherein the rotatable member is sized and configured to move between the first and second positions when the support structure is moved between the use and collapsed positions; and wherein the movement of the support structure between the use and collapsed positions moves the locking member between the locked and unlocked positions.

4. The locking mechanism as in claim 1, wherein rotation of the rotatable member between the first and second positions simultaneously moves the locking member between the locked and unlocked positions.

5. The locking mechanism as in claim 1, wherein the first connector is connected to the rotatable member in a fixed position; and wherein the second connector is pivotally connected to the first connector.

6. The locking mechanism as in claim 1, wherein the locking member is sized and configured to engage the hinge assembly in the locked position to prevent the hinge assembly from rotating; and wherein the locking member is sized and configured to be disengaged from the hinge assembly in the unlocked position to allow the hinge assembly to rotate.

7. The locking mechanism as in claim 1, wherein the hinge assembly of the folding table includes a first flange and a second flange;

wherein the rotatable member is inserted through an opening in the first flange and the second flange; and wherein the first connector is at least partially disposed between the first and second flanges of the hinge assembly.

8. The locking mechanism as in claim 1, wherein the first connector is connected to the rotatable member in a fixed position;

wherein the second connector is pivotally connected to the first connector; and wherein the second connector is connected to the locking member in a fixed position.

9. A locking mechanism sized and configured to be used with a fold-in-half table, the fold-in-half table including a table top with a first section and a second section movable between a folded position and an unfolded position, the fold-in-half table including a frame including a first portion connected to the first section of the table top and a second portion connected to the second section of the table top, the fold-in-half table including a hinge assembly connecting the first and second sections of the table top, and the fold-in-half table including at least one support structure sized and configured to support the table top above a surface, the support structure movable between a use position and a collapsed position, the locking mechanism for a fold-in-half table comprising:

a cross member sized and configured to be rotatably connected to the table top, the cross member rotatable between a first position and a second position relative to the table top;

a first connector connected to the cross member in a fixed position, the first connector including an outwardly extending portion;

a second connector pivotally coupled to the outwardly extending portion of the first connector; and a locking member movable between a locked position and an unlocked position;

wherein rotation of the cross member causes the first connector to move;

wherein movement of the first connector causes the second connector to move; and wherein movement of the second connector causes the locking member to move between the locked and unlocked positions.

10. The locking mechanism as in claim 9, wherein when the support structure is moved between the extended and collapsed positions, the locking mechanism moves between the locked and unlocked positions; and wherein when the support structure is in the extended position and the locking mechanism is in the locked position, the table top is secured in the unfolded position.

11. The locking mechanism as in claim 9, wherein the hinge assembly includes two or more flanges, the first connector and the second connector of the locking mechanism being at least substantially disposed between the flanges of the hinge assembly.

12. The locking mechanism as in claim 9, wherein the first connector is movable between a first position and a second position;

wherein the second connector is movable between a first position and a second position;

wherein rotation of the cross member between the first and second positions causes the first connector to move between the first and second positions;

wherein movement of the first connector between the first and second positions causes the second connector to move between the first and second positions; and wherein movement of the second connector between the first and second positions moves the locking member between the locked and unlocked positions.

13. A locking mechanism sized and configured to be used with a folding table, the folding table including a table top with a first section and a second section that are capable of being moved between a folded and an unfolded position, the folding table including a hinge assembly connecting the first section and the second section of the table top, the folding table including a support structure sized and configured to support the table top above a surface, the support structure movable between a use position and a collapsed position relative to the table top, the folding table including a cross brace connected to the support structure, the locking mechanism comprising:

a rotatable member sized and configured to be connected to the folding table;

a first connecting member coupled to the rotatable member, the first connecting member including an outwardly extending portion;

a second connecting member pivotally coupled to the outwardly extending portion of the first connecting member; and a locking member connected to the second connecting member, the locking member movable between a locked position and an unlocked position.

14. The locking mechanism as in claim 13, wherein the rotatable member is sized and configured to be connected to the cross brace of the folding table; and wherein movement of the cross brace rotates the rotatable member.

15. The locking mechanism as in claim 13, wherein the cross brace is sized and configured to be connected to the rotatable member in a fixed position so that movement of the cross brace between a collapsed position and an extended position causes rotation of the rotatable member between a first position and a second position; and wherein rotation of the rotatable member between the first and second positions causes the locking member to move between the locked and unlocked positions.

16. The locking mechanism as in claim 13, wherein the first connecting member is connected to the rotatable member in a fixed position; and wherein the second connecting member is pivotally connected to the first connecting member.

17. The locking mechanism as in claim 13, wherein the rotatable member is sized and configured to be rotatably connected to the hinge assembly, the locking member sized and configured to engage the hinge assembly in the locked position to prevent the hinge assembly from rotating, the locking member sized and configured to be disengaged from the hinge assembly in the unlocked position to allow the hinge assembly to rotate.

18. The locking mechanism as in claim 17, wherein the hinge assembly of the folding table includes a first flange and a second flange, the rotatable member sized and configured to be inserted through an opening in the first flange and the second flange, the first connecting member at least partially disposed between the first and second flanges of the hinge assembly.

19. The locking mechanism as in claim 13, wherein the second connecting member is pivotally connected to the first connecting member; and wherein the second connecting member is connected to the locking member in a fixed position.

20. The locking mechanism as in claim 13, wherein the first connector is movable between a first position and a second position;

wherein the second connector is movable between a first position and a second position;

wherein rotation of the cross member between the first and second positions causes the first connector to move between the first and second positions;

wherein movement of the first connector between the first and second positions causes the second connector to move between the first and second positions; and wherein movement of the second connector between the first and second positions moves the locking member between the locked and unlocked positions.

* * * * *